US006743371B2

(12) United States Patent
John et al.

(10) Patent No.: US 6,743,371 B2
(45) Date of Patent: Jun. 1, 2004

(54) MAGNETO SENSITIVE FLUID COMPOSITION AND A PROCESS FOR PREPARATION THEREOF

(75) Inventors: Reji John, Kochi (IN); Narayana Das Janardhan Pillai, Kochi (IN)

(73) Assignee: The Adviser-Defence Research & Development Organisation Ministry of Defence, Government of India, New Delhi (IN)

( * ) Notice: Subject to any disclaimer, the term of this patent is extended or adjusted under 35 U.S.C. 154(b) by 0 days.

(21) Appl. No.: 10/149,000

(22) PCT Filed: Oct. 3, 2001

(86) PCT No.: PCT/IN01/00168

§ 371 (c)(1),
(2), (4) Date: Jun. 6, 2002

(87) PCT Pub. No.: WO02/29833

PCT Pub. Date: Apr. 11, 2002

(65) Prior Publication Data

US 2003/0025102 A1 Feb. 6, 2003

(51) Int. Cl.[7] ..... H01F 1/44

(52) U.S. Cl. ..... 252/62.52; 252/570; 252/572

(58) Field of Search ..... 252/62, 52, 570, 252/572

(56) References Cited

U.S. PATENT DOCUMENTS

| | | | |
|---|---|---|---|
| 4,992,190 | A | 2/1991 | Shtarkman |
| 5,534,488 | A | 7/1996 | Hoffmann |
| 5,578,238 | A | 11/1996 | Weiss et al. |
| 6,027,664 | A | 2/2000 | Weiss et al. |

*Primary Examiner*—C. Melissa Koslow
(74) *Attorney, Agent, or Firm*—Venable LLP; Marina V. Schneller

(57) ABSTRACT

The present invention relates to a magneto sensitive fluid composition and a process of its preparation. The electrical conductivity of the composition varies reversibly in the presence of an external magnetic field. The composition, which is practically an insulator, starts behaving as a conductor in the presence of a magnetic field. The fluid is basically a magnetrheological composition in which the magnetic sensitive particles are admixed with conductive additives in the form of conductive metallic or non-metallic powder. The change in electrical conductivity of the composition is in addition to the change in rheological characteristics of the composition in the presence of an external magnetic field.

10 Claims, No Drawings

MAGNETO SENSITIVE FLUID COMPOSITION AND A PROCESS FOR PREPARATION THEREOF

FIELD OF INVENTION

This invention relates to magneto sensitive fluid composition exhibiting electrical switching as well as magnetorheological characteristics in the presence of external magnetic field and a process for preparing the same.

PRIOR ART

Ferrofluids are colloidal liquids in which ferromagnetic materials are uniformly suspended and which exhibit changes in their rheological characteristics in the presence of external magnetic field. These ferrofluids could be electrically non-conductive as well as electrically conductive. Electrically conductive ferrofluids comprise a liquid carrier medium, finely divided magnetic particles and electrically conductive particles to impart electrical conductivity to the ferrofluid. The carrier fluids employed in the ferrofluids could be hydrocarbons, mineral oils, ester based oils or even water. The magnetic particles employed in the ferrofluids could be ferromagnetic materials such as nickel, cobalt, iron, metal carbides, metal oxides and metal alloys etc. Generally, the size of ferromagnetic particles is less than 1000 angstroms. To impart conductivity to the ferrofluids, various forms of carbon like graphite, diamond etc. are used. The magnetic particles and electrically conductive particles are uniformly dispersed and stabilised by using surfactants. Again, a variety of surfactants are utilised depending upon the need for dispersion and uniformity. These non-conducting as well as conducting ferrofluids are known in the prior art. However, these ferromagnetic compositions do not exhibit significant change in their conductivity in presence of any external magnetic field.

A magnetorheological fluid composition comprises magnetic sensitive particles dispersed in a carrier fluid with the help of surfactants. The magnetic responsive particles employed could be iron oxide, iron, iron carbide, low carbon steel or alloys of cobalt, zinc, nickel, manganese etc. The carrier fluid employed could be mineral oils, hydrocarbon oils, polyester and phosphate esters etc. These magnetorheological fluid compositions exhibit changes in its rheological characteristics when subjected to external magnetic field. In absence of magnetic field, the magnetorheological fluids have measurable viscosity, which depends upon several parameters like shear rate, temperature etc. However, in the presence of an external magnetic field, the viscosity of the fluid increases to a very high value as the suspended particle align themselves resulting in rapid physical gelling of the fluid. These known magnetorheological fluids are either electrically insulating or conducting. Although, a few magneto active materials exhibit change in electrical conductivity in the presence of an external magnetic field, these materials are neither fluids nor they exhibit any significant change in, their electrical conductivity.

These magnetorheological as well as ferromagnetic fluid compositions, known in the prior art suffer from following disadvantages.

The main disadvantage of magnetorheological as well as ferromagnetic fluids known in the prior art is that these fluid compositions do not exhibit any significant change in electrical conductivity under the influence of external magnetic field and as such these fluids can not be utilised in electrical switching applications.

Another disadvantage of magnetorheological as well as ferromagnetic fluids known in the prior art is that these fluid compositions do not exhibit any change in capacitance value under the influence of external magnetic field and as such these fluid can not be utilised for such an applications where variation in capacitance is required.

OBJECTS OF THE INVENTION

Primary object of the invention is to provide a magneto sensitive fluid composition and a process for preparing the same wherein the composition exhibits excellent electrical switching characteristics, in addition to magnetorheological characteristics, in the presence of an external magnetic field.

Another object of the invention is to provide a magneto sensitive fluid composition and a process for preparing the same wherein the electrical resistance of the composition can be continuously varied from a high value of 10 ohm to a very low value of 1 ohm depending upon the strength of the external magnetic field applied.

Still another object of the invention is to provide a magneto sensitive fluid composition and a process for preparing the same wherein the composition exhibits change in capacitance over a wide range under the influence of an external magnetic field.

Yet further object of the invention is to provide a magneto sensitive fluid composition and a process for preparing the same wherein the composition has excellent magnetorheological properties in combination with electrical switching characteristics.

Still another object of the invention is to provide a magneto sensitive fluid composition and a process for preparing the same wherein the composition has excellent magnetorheological properties in combination with variable capacitance.

Still further object of the invention is to provide a magneto sensitive fluid composition and a process for preparing the same wherein the composition has low hysteresis characteristics.

Yet further object of the invention is to provide a magneto sensitive fluid composition and a process for preparing the same wherein the composition can be used over a wide operating temperature range varying from −10° C. to +80° C.

Still another object of the invention is to provide a magneto sensitive fluid composition and a process for preparing the same wherein the viscosity of the composition along with electrical resistance and capacitance can be continuously varied by varying the strength of the external magnetic field.

Yet further object of the invention is to provide a magneto sensitive fluid composition and a process for preparing the same wherein the Brookfield Viscosity of the composition can be changed continuously over a wide range, typically from 700 CP to 120000 CP or better.

Still further object of the invention is to provide a magneto sensitive fluid composition having variable electrical resistance and capacitance for making sensors or devices wherein change of either electrical resistance or capacitance in the presence of a magnetic field is desired. Few examples of such possible sensors or devices are non-arcing relays, high voltage protector, variable resistors, tilt sensors, magnetic mine sensors, microwave shielding devices, proximity fuses for torpedoes etc.

DESCRIPTION OF THE INVENTION

According to this invention there is provided a magneto sensitive fluid composition having electrical switching and magnetorheological characteristics in presence of an external magnetic field, comprising:

a) a carrier fluid, b) magnetic sensitive particles comprising 85–98% by weight of high purity iron particles, such as carbonyl iron, dry blended with 2–15% by weight of ferrite, c) magnetic sensitive particles comprising 50–90% by weight of said magnetic sensitive particles admixed with 10–50% by weight of a conductive metallic or non-metallic additive, d) magnetic sensitive particles stabiliser synthesised from said carrier fluid; said doped magnetic sensitive particles coated with said magnetic sensitive particles stabiliser uniformly dispersed in the said carrier fluid.

The external magnetic field, induces alignment in the magnetic sensitive particles dispersed in the carrier fluid medium which, in turn, apart from changing the reheological characteristics, also changes the electrical conductivity of the composition. Apparently, the aligned magnetic sensitive particle act in an organised manner so as to facilitate conduction of electrons induced by the added additives. This conduction of electrons is essentially responsible for change in the characteristic of the fluid from a non-conducting material to a conductive material. The suspended particles align to form a chain like structure in the presence of a magnetic field and a conductive path is formed for the conduction of electrons. Through this path, the electrons contributed by the added additives conduct and fluid starts behaving as a conductive material. Once the external magnetic field is removed, the alignment of magnetic particles is disturbed and the conduction path for the electrons is no longer available. This results in the reversal of the characteristic of the material and it starts behaving as an insulator.

The present composition utilises a derivative of vegetable oil extracted from agro-seed such as castor oil as carrier fluid. This carrier fluid i.e. vegetable oil is cheaper, easily available, eco-friendly, bio-compatible and has a renewable source of supply. The composition utilises iron and its alloys, iron oxides, iron carbide, carbonyl, iron nitrides etc. as magnetic sensitive particles. The proposed process for preparation of the magneto sensitive fluid composition is simpler and it does not require complex machinery. Further, the composition is highly homogeneous as it utilises magnetic sensitive particles modifier or surfactant, which is synthesised from the very carrier fluid, employed in the composition. This surfactant improves the homogeneity of the composition and reduces gravity settling problems of the magnetic sensitive particles.

The useful conductive metal additives include powders of gold, silver, copper, aluminum, or any other conductive metallic powders, while conductive nonmetallic powders include graphite, conductive carbon black or any other nonmetallic conductive powders.

The present magneto sensitive composition can be utilised for making sensors or devices wherein change of either electrical resistance or capacitance in the presence of a magnetic field is desired. Few examples of such possible sensors or devices are non-arcing relays, high voltage protector, variable resistors, tilt sensors, magnetic mine sensors, microwave shielding devices, proximity fuses for torpedoes etc.

DETAILED DESCRIPTION OF THE PROCESS (i) Preparation of Magnetic Sensitive Particle 85–98% by weight of high purity iron particles (such as carbonyl iron) and 2–15% by weight of ferrite of nickel and zinc (such as nickel-Zinc ferrite) are dry blended using a powder blender.

(ii) Admixing of the Magnetic Sensitive Particles with Conductive Particles

50–90% by weight of the mix obtained from step (i) is dry blended with 10–50% by weight of any conductive metallic or non metallic powder such as silver, graphite powder etc. using a powder blender.

(iii) Preparation of Stabiliser for Magnetic Sensitive Particles Obtained from Step (ii)

0.50–2.5% by weight of con, sulphuric acid (assay 98%) is poured drop wise to 95–99% by weight of a carrier fluid preferably commercially available castor oil (viscosity about 700–800 Cps,) and mixed using a laboratory stirrer at a temperature between 25–30°. The mix is allowed to react for two hours while maintaining the temperature between 25–30°.

To the above mix, 0.5–2.5% by weight of 20% aqueous solution of potassium hydroxide (potassium hydroxide pellets >85% purity dissolved in distilled water) is added drop wise and mixed using a laboratory stirrer. The reaction is allowed to continue for about two more hours. The temperature, throughout the reaction, is maintained between 25–30° C. by using a water bath. The particle stabiliser, thus obtained, is washed with distilled water till the pH of water becomes neutral.

(iv) Coating of Magnetic Sensitive Particles Obtained from Step (ii) with the Stabiliser Obtained Form Step (iii)

1–10% of the magnetic particles stabiliser obtained from step (iii) is preheated to a temperature between 60 and 80° C. and poured drop wise to 90–99% by weight of the magnetic sensitive particles obtained from step (ii) in a laboratory kneader and is mixed properly. The stabiliser coated magnetic sensitive particles, thus obtained are in the consistency of putty. This putty is allowed to mature for 24 hours at a temperature between 25–30° C.

(v) Synthesis of Magneto Sensitive Fluid Formulation

80–90% by weight of coated and magnetic sensitive particles obtained from step (iv) is mixed with 10–20% by weight of the carrier fluid as used in step (iii) preferably commercially available castor oil (viscosity between 500–700 Cps). Before mixing, the carrier fluid, preferably commercially available castor oil, is heated up to 60–80° C. in a container and the said coated and magnetic sensitive particles are added to it in a gradual manner under continuous stirring with a laboratory stirrer. The entire mix is further homogenised in a high-speed mixer by raising the mixing speed from low rpm to about 2000 rpm within the first 10 minutes of mixing. The mixing is continued for about one hour at this mixing speed followed by cooling of the mix to about 30° C. The mixture is further agitated at a high rpm of about 2500–3000 for about 3–5 minutes and followed by cooling it to room temperature. The above agitation process at 2500–3000 rpm is repeated once again to finally obtain magneto sensitive fluid composition.

The invention will now be illustrated with working examples, which are typical examples to illustrate the working of the invention and are not intended to be taken restrictively to imply any limitation on the scope of the present invention.

WORKING EXAMPLE-I 60 gm of high purity iron powder and 2.50 gm of nickel-zinc ferrite are dry blended using a powder blender to prepare magnetic sensitive particles. Next, these particles and 20 gm silver powder are dry blended in a powder blender to obtain magnetic sensitive particles. Next, 2.45 gm of castor oil of commercial purity is mixed with 0.025 gm of concentrated sulfuric acid in a container followed by allowing the mix to react for 2 hours, while maintaining the temperature of the reaction to about 30° C. using a water bath. In the next step, 0.025 gm of potassium hydroxide is dissolved in 2.0 ml distilled water in a container to prepare aqueous solution of potassium hydroxide. This aqueous solution is added drop wise to the reaction product of castor oil and sulphuric acid under continuous stirring followed by allowing this mix to react for two more hours, while maintaining the temperature to the same level. The mix is then washed with distilled water till the pH of the water becomes neutral. The magnetic sensitive particles stabiliser, thus obtained, is utilised to coat the magnetic sensitive particles using a laboratory kneader. Before mixing, the magnetic particles stabiliser is pre-heated to 70° C. and is added drop wise to the magnetic sensitive particles, the stabiliser coated magnetic sensitive particles, thus obtained, is allowed to mature for 24 hours at 30° C. Next, 15 gm of castor oil is heated to 70° C. in a container and stabiliser coated magnetic sensitive particles are added to it an mixed homogeneously using a high speed mixer in a step wise manner. In the first step, mixing speed of the mixer is increased from 500 rpm to 2000 and the mix is allowed to cool down to the room temperature. In the next step, the mix is agitated at the high speed of 3000 rpm for 3 minutes and once again it is allowed to cool down to the room temperature. The above homogenising cycle is repeated once again to finally obtain 100 gm magneto sensitive composition of the present invention.

WORKING EXAMPLE-II 55.75 gm of high purity iron particles and 2.0 gm of manganese-zinc ferrite are dry blended using a powder blender to prepare magnetic sensitive particles. Next, these particles and 23.75 gm of silver powder are dry blended in a powder blender to obtain doped magnetic sensitive particles. Next, 4.0 gm of castor oil or commercial purity is mixed with 0.15 gm of con. Sulfuric acid in a container followed by allowing the mix to react for about two hours while maintaining the temperature to 28° C. using a water bath. Further, this mix is allowed to react for 2 hours at the same temperature. In the next step, 0.15 gm of potassium hydroxide is dissolved in 2.0 ml distilled water in a container to prepare aqueous solution of potassium hydroxide. This aqueous solution of potassium hydroxide is added drop wise to the reaction product of castor oil and sulfuric acid under continuous stirring followed by allowing this entire mix to react for about two hours while maintaining the temperature to the same level. The mix is washed with distilled water till the pH of the water becomes neutral. The magnetic sensitive particles stabiliser, thus obtained, is utilised to coat the dry blended magnetic sensitive particles using a laboratory kneader. The stabiliser coated magnetic sensitive particles are allowed to mature for 24 hours. Next, 14.2 gm of castor oil is heated to 70° C. in a container and stabiliser coated magnetic sensitive particles are added to it and mixed homogeneously using a high speed mixer in a step wise manner. In the first step, the mixing speed of the mixer is increased from 500 rpm to 2000 rpm and mixture is allowed to cool down to room temperature. In the next step, the mixture is agitated at high speed of 3000 rpm for 3 minutes and once again it is allowed to cool down to the room temperature. The above homogenising cycle is repeated once again to finally obtain 100 gm magneto sensitive composition of the present invention.

It is to be understood that the process of the present invention is susceptible to adaptation, changes and modification by those skilled in the art. Such adaptations, changes and modifications are intended to be within the scope of the present invention, which is further set forth with the following claims.

We claim:

1. A magneto sensitive fluid composition having electrical switching and magnetorheological characteristics in the presence of an external magnetic field comprising:

(a) 10–20% by weight of castor oil as a carrier fluid; and (b) 80–90% by weight of a mixture of magnetic sensitive particles and conductive particles;

wherein, the said mixture of the said magnetic sensitive particles and the said conductive particles are obtained by mixing 50–90% by weight of the said magnetic sensitive particles and 10–50% by weight of the said conductive particles;

wherein, the said magnetic sensitive particles are obtained by blending 85–98% by weight of high purity iron particles and 2–15% by weight of ferrite;

wherein, the said mixture of the said magnetic sensitive particles and the said conductive particles are coated with magnetic sensitive particle stabilizer and said carrier fluid.

2. A magneto sensitive fluid composition as claimed in claim 1, wherein the said magnetic particle stabilizer is synthesized by reacting 95–99% by weight of the said carrier fluid, 0.5–2.5% by weight of concentrated sulphuric acid and 0.5–2.5% by weight of aqueous solution of potassium hydroxide.

3. A magneto sensitive fluid composition as claimed in claim 1, wherein the said coating of the said mixture of the said magnetic sensitive particles and the said conductive particles comprise 1–10% by weight of the said magnetic sensitive particle stabilizer based on the weight of the said mixture of the said magnetic sensitive particles and the said conductive particles.

4. A magneto sensitive fluid composition as claimed in claim 1, wherein, the said high purity iron particles are carbonyl iron particles.

5. A magneto sensitive fluid composition as claimed in claim 1, wherein the said conductive particles are selected from the group consisting of gold, silver, copper, aluminum and graphite.

6. A magneto sensitive fluid composition as claimed in claim 1, wherein the said ferrite is nickel-zinc ferrite or manganese-zinc ferrite.

7. A process for the preparation of magneto sensitive fluid composition having electrical switching and magnetorheological characteristics in the presence of an external magnetic field, the said process comprising the steps of:

(i) preparing magnetic sensitive particles by blending 85–98% by weight of high purity iron particles and 2–15% by weight of ferrite;

(ii) preparing mixture of the said magnetic sensitive particles and conductive particles by mixing 50–90% by weight of the said magnetic sensitive particles obtained in step (i) with 10–50% by weight of conductive particles;

(iii) preparing magnetic sensitive particles stabilizer by adding 0.5–2.5% by weight of concentrated sulphuric acid drop wise to 95–99% by weight of castor oil under continuous stirring and reacting with temperature maintained at about 25–30° C., adding 0.5–2.5% by weight of aqueous solution of potassium hydroxide drop wise to the reaction product of sulphuric acid and castor oil under continuous stirring, allowing the entire mix to react with the temperature maintained at about 25–30° C., washing the magnetic sensitive particle stabilizer so obtained;

(iv) coating the said mixture of the said magnetic sensitive particles and the said conductive particle obtained from step (ii) with the said magnetic particle stabilizer prepared in step (iii) by preheating 1–10% of the said magnetic sensitive particle stabilizer to 60–80° C., adding it drop wise to 90–99% by weight of the said mixture of the said magnetic sensitive particles and the said conductive particles, mixing both with a laboratory kneader and allowing the coated particles to mature at about 25–30° C.

(v) synthesizing magneto sensitive fluid composition by heating 10–20% by weight of the said castor oil to 60–80° C., adding 80–90% by weight of the coated mixture of the said magnetic sensitive particles and the said conductive particles obtained in step (iv) to it, homogenizing the mix, and allowing the said mix and finally cooling the magneto sensitive fluid composition, thus obtained, to room temperature.

8. A process for the preparation of magneto sensitive fluid composition as claimed in claim 7, wherein, the said high purity iron particles are carbonyl iron particles.

9. A magneto sensitive fluid composition as claimed in claim 7, wherein the said conductive particles are selected from the group consisting of gold, silver, copper, aluminum and graphite.

10. A process for the preparation of magneto sensitive fluid composition as claimed in claim 7, wherein the said ferrite is nickel-zinc ferrite or manganese-zinc ferrite.

* * * * *

UNITED STATES PATENT AND TRADEMARK OFFICE

CERTIFICATE OF CORRECTION

PATENT NO. : 6,743,371 B2
DATED : June 1, 2004
INVENTOR(S) : Reji John et al.

It is certified that error appears in the above-identified patent and that said Letters Patent is hereby corrected as shown below:

Title page,
Insert Item --[30], Foreign Application Priority Data, "October 6, 2000, IN 892/DEL/2000 --.

Signed and Sealed this

Twenty-third Day of November, 2004

JON W. DUDAS
*Director of the United States Patent and Trademark Office*